US010041310B2

(12) United States Patent
Robichaux et al.

(10) Patent No.: US 10,041,310 B2
(45) Date of Patent: Aug. 7, 2018

(54) METHOD AND APPARATUS FOR AUTOMATED CONNECTION OF A FLUID CONDUIT

(71) Applicant: Blackhawk Specialty Tools, LLC, Houston, LA (US)

(72) Inventors: Ron D. Robichaux, The Woodlands, TX (US); James G. Martens, Houston, TX (US); John E. Hebert, Houma, LA (US); Juan Carlos E. Mondelli, Houston, TX (US); James Champagne, Houma, LA (US); Joseph Boudreaux, Houma, LA (US); Scottie J. Scott, Houma, LA (US); Jeremy LeCompte, Houma, LA (US)

(73) Assignee: Blackhawk Specialty Tools, LLC, Houston, TX (US)

( * ) Notice: Subject to any disclaimer, the term of this patent is extended or adjusted under 35 U.S.C. 154(b) by 0 days.

(21) Appl. No.: 15/631,068

(22) Filed: Jun. 23, 2017

(65) Prior Publication Data

US 2017/0298700 A1 Oct. 19, 2017

Related U.S. Application Data

(63) Continuation-in-part of application No. 15/013,156, filed on Feb. 2, 2016, now Pat. No. 9,689,216, which (Continued)

(51) Int. Cl.

| | |
|---|---|
| ***E21B 19/00*** | (2006.01) |
| ***E21B 34/00*** | (2006.01) |
| ***E21B 33/05*** | (2006.01) |
| *E21B 33/13* | (2006.01) |
| *E21B 43/26* | (2006.01) |
| *E21B 47/06* | (2012.01) |

(52) U.S. Cl.

CPC ..... *E21B 19/00* (2013.01); *E21B 19/008* (2013.01); *E21B 33/05* (2013.01); *E21B 34/00* (2013.01); *E21B 33/13* (2013.01); *E21B 43/26* (2013.01); *E21B 47/06* (2013.01)

(58) Field of Classification Search

CPC ..... E21B 19/00; E21B 19/008; E21B 33/05; E21B 33/13; E21B 33/038; E21B 43/26; E21B 47/06

See application file for complete search history.

(56) References Cited

U.S. PATENT DOCUMENTS

| | | | | |
|---|---|---|---|---|
| 3,968,838 A * | 7/1976 | Baugh | ..... | E21B 43/0135 166/347 |
| 2004/0011424 A1* | 1/2004 | Dupont | ..... | B67D 9/00 141/279 |

(Continued)

*Primary Examiner* — Robert Edward Fuller
*Assistant Examiner* — Christopher J Sebesta
(74) *Attorney, Agent, or Firm* — Ted M. Anthony

(57) ABSTRACT

A connection assembly for automated lifting and positioning of a chiksan or other fluid conduit in proximity to a fluid inlet of a device such as, for example, a cement or hydraulic fracturing head. Once a chiksan or other flow line is positioned in a desired location, a secure connection is made between the outlet of the chiksan or other fluid conduit and the fluid inlet including, without limitation, when the device is positioned at an elevated location above a rig floor.

16 Claims, 15 Drawing Sheets

Related U.S. Application Data is a continuation of application No. 14/566,694, filed on Dec. 10, 2014.

(60) Provisional application No. 61/914,476, filed on Dec. 11, 2013.

(56) References Cited

U.S. PATENT DOCUMENTS

| | | | | |
|---|---|---|---|---|
| 2009/0065199 | A1* | 3/2009 | Patel | E21B 23/03<br>166/250.01 |
| 2012/0133122 | A1* | 5/2012 | Hovik | B63B 27/24<br>285/27 |
| 2013/0284457 | A1* | 10/2013 | Laurel | E21B 17/05<br>166/380 |

* cited by examiner

METHOD AND APPARATUS FOR AUTOMATED CONNECTION OF A FLUID CONDUIT

BACKGROUND OF THE INVENTION

1. Field of the Invention

The present invention pertains to an automated assembly for connecting a fluid flow line to an inlet port. More particularly, the present invention pertains to an automated assembly for connecting a fluid flow line (such as a chiksan, hose or other conduit) to an inlet port of a cement head or hydraulic fracturing ("frac") head assembly.

2. Brief Description of the Related Art

Many offshore oil and/or gas wells are drilled in marine environments using floating vessels (such as, for example, drill ships and semi-submersible drilling rigs), particularly prior to installation of a permanent platform or other similar structure. Drilling operations conducted from such floating vessels differ from those conducted from permanent structures in many respects.

One important difference associated with drilling from a floating vessel is the location of blowout preventer and wellhead assemblies. When drilling from a fixed platform or other similar structure, a blowout preventer assembly is typically located on a rig, platform or other structure. However, when drilling from a floating drilling vessel, blowout preventer and wellhead assemblies are not located on the drilling rig, platform or other structure; rather, such assemblies are located at or near the sea floor. As a result, specialized equipment known as "subsea" blowout preventer and wellhead assemblies typically must be utilized.

During cementing operations, an apparatus known as a cement head is typically installed above a rig's work surface or "rig floor" in order to provide a connection or interface between a rig's lifting system and surface pumping equipment, on the one hand, and down hole work string and/or other tubular goods extending into a well, on the other hand. Such cement heads must permit cement slurry to flow from a pumping assembly into a well, and should have sufficient flow capacity to permit high pressure pumping of large volumes of cement and other fluids at high flow rates. Such cement heads must also have sufficient tensile strength to support heavy weight tubular goods and other equipment extending from the rig into a well, and to accommodate raising and lowering of such tubular goods and equipment.

Although such cement heads are typically utilized in connection with wells drilled in offshore or marine environments, it is to be observed that such cement heads can also be used in connection with the drilling/equipping of onshore wells using land-based drilling rigs. Furthermore, such cement heads are frequently (although not necessarily exclusively) utilized on onshore and offshore drilling rigs equipped with top drive drilling systems. In certain circumstances, said cement heads are used on rigs equipped with a kelly and rotary table, instead of a top drive unit.

In many cases, such cement heads must be positioned high above a rig floor during cementing operations. In such situations, a fluid conduit must extend from a rig's pumping system (which is typically located at or near the rig floor level) to said elevated cement head. On drilling rigs equipped with a top drive system, it is possible to pump cement and/or other fluids from a rig's pumping system through said top drive unit and a top drive hose extending to a cement head. However, such a configuration is not preferred for cementing operations, because an unexpected loss of power or pumping shut down could result in cement slurry hardening within the top drive unit, top drive hoses and/or ancillary equipment, causing significant damage and/or downtime for such critical equipment.

As a result, a rig's top drive system is frequently bypassed for this purpose and a temporary fluid conduit is typically utilized to connect a surface cement pumping system to the inlet port of a cement head, and to provide cement slurry to said cement head. Such temporary fluid conduit, which can be relatively heavy, can comprise a high pressure hose, a swiveled flow-link apparatus commonly referred to as a "chiksan", or other flow line(s).

Because a cement head may be located at an elevated location above a rig floor, the distal end or outlet of said fluid conduit typically must also be lifted to an elevated location in order to position it in close proximity to said cement head. Further, such fluid conduit must be securely coupled or connected to a fluid inlet port on said elevated cement head in order to permit pressurized fluid (including, without limitation, heavy cement slurry) to flow through said cement head.

In many instances, a cement head will typically be positioned at an elevated position out of reach of personnel working on a rig floor, thereby making it difficult for such personnel to easily access the cement head in order to connect chiksans, flow lines and/or other fluid conduits to said cement head. Moreover, such personnel often must be hoisted off the rig floor using a makeshift seat or harness attached to a winch or other lifting device in order to reach the cement head for this purpose. When this occurs, such personnel are at risk of falling and suffering serious injury or death. Moreover, such personnel are frequently required to carry heavy hammers, wrenches and/or other tools used to facilitate connection of the flow conduit to the cement head inlet, thereby increasing the risk of such items being accidentally dropped on personnel and/or equipment positioned on the rig floor below.

Further, subterranean hydrocarbon formations are routinely stimulated to enhance their geological permeability and productivity. One common technique for stimulating hydrocarbon formations is to hydraulically fracture a formation by pumping into the well highly pressurized fluids containing suspended proppants, such as sand, resin-coated sand, sintered bauxite or other such abrasive particles. Such fluid and particulate mixtures are commonly referred to as slurries.

During hydraulic fracturing operations these slurries are frequently moved at high pressure from one or more pumps through a pressure containing line to a fracturing head. The fracturing head is typically attached to a wellhead valve secured to the top of the constructed well. The high pressure and typically high fluid flow rates require the architecture of the well head, wellhead valve(s), fracturing head (or "frac head"), connectors, adaptors, conduits, and flanges to be large and robust. High pressure conduits or flow lines conveying the slurry are typically attached at or near the top of the frac head through one or more side entry ports.

In many cases, such side entry ports can be 20 feet or more above the ground or rig support structure. The heavy pressure containing lines must be manually manipulated and attached to the frac head side entry ports prior to pumping. In marine applications, such side entry ports are much higher as consideration must be made for rig heave and movement. Again the heavy pumping lines must be manually manipulated and attached by personnel in a riding harness, lift basket or other device.

Thus, there is a need for a method and apparatus for lifting/positioning of a chiksan or other fluid conduit in proximity to a lifting top drive cement head, as well as secure connection of said chiksan or other fluid conduit to a lifting top drive cement head including, without limitation, when said lifting top drive cement head is positioned at an elevated location above a rig floor. Such lifting and connection should be beneficially accomplished without the need for lifting or raising personnel to an elevated position above said rig floor and/or in close proximity to said cement head inlet.

Further, there is a clear need to eliminate the risk of placing personnel at elevated locations to perform manual labor associated with connection of frac heads, reduce the time needed to connect high pressure conduits to such frac heads, and to eliminate risk of dropped objects. Consequently, there exists a need for a method and apparatus to remotely, efficiently, and safely attach high pressure conduits to such fracturing heads.

SUMMARY OF THE INVENTION

The automated connection assembly of the present invention generally comprises a hoist or lifting assembly mounted at or near a cement or frac head that can attach to the distal end or outlet of a high pressure hose or chiksan line. Said lifting assembly can be used to selectively draw or otherwise motivate said outlet conduit end toward a fluid inlet having an attachment device (such as, for example, a quick-lock receptacle) attached to or in fluid communication with a cement or frac head. Once said outlet conduit end has been beneficially moved to a desired position, said outlet conduit can be securely received by and operationally attached to said receptacle to facilitate flow of pressurized fluids through said conduit and into said cement or frac head.

Although the specific configuration of the present invention can vary, in a preferred embodiment the automatic connection assembly of the present invention comprises a winch assembly that can be mounted above or otherwise in proximity to a cement or frac head. A cable extends from said winch assembly to a stinger assembly or member operationally attached to the distal end (outlet) of a chiksan or other temporary fluid conduit.

By retracting or winding said winch assembly, said cable acts to lift and draw said stinger assembly and distal end of said chiksan/fluid conduit toward a quick lock receptacle which is in fluid communication with an inlet port of said cement or frac head. Said quick lock receptacle can comprise a downwardly facing and substantially conical or tapered entry guide to direct said distal end of said chiksan/fluid conduit to an inlet port of said quick lock receptacle.

After said stinger assembly attached to the distal end of said chiksan/fluid conduit is received by said quick lock receptacle, said quick lock receptacle can be remotely actuated in order to securely connect said stinger assembly in place and form a fluid pressure seal to permit pumping of pressurized fluid (such as, for example, cement slurry) through said chiksan/fluid conduit and into said cement or frac head. Following pumping operations, said quick lock receptacle can be remotely actuated to disconnect said stinger assembly and the attached chiksan/fluid conduit. Thereafter, said winch assembly can be actuated to extend said cable and lower said stinger assembly and the distal end of said chiksan/fluid conduit (such as to personnel situated on a rig floor) for further handling.

In a preferred embodiment, the automated connection assembly of the present invention can further comprise at least one safety pressure switch that senses the existence of an elevated fluid pressure across said connection, or a pressure differential, as well as controller that prevents disconnection in the event that either such condition is sensed. Additionally, cable roller guides can protect winch cables as they pass through various openings during operation of the present invention, while ear guards and other protective shields can also be employed.

The automated connection assembly of the present invention eliminates the need for hoisting or otherwise lifting personnel to an elevated location within a drilling rig derrick in order to connect a fluid flow conduit (such as a high pressure hose or chiksan line) to the inlet of an elevated cement or frac head. In a preferred embodiment, such functions are controlled remotely by personnel situated on a drilling rig floor or other convenient staging area. Although the automated connection assembly of the present invention is described herein primarily in connection with cement head technology and cementing operations, it is to be observed that said automated connection assembly can be used to connect a fluid conduit to any number of other tools or equipment situated at an elevated location.

BRIEF DESCRIPTION OF THE DRAWINGS/FIGURES

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
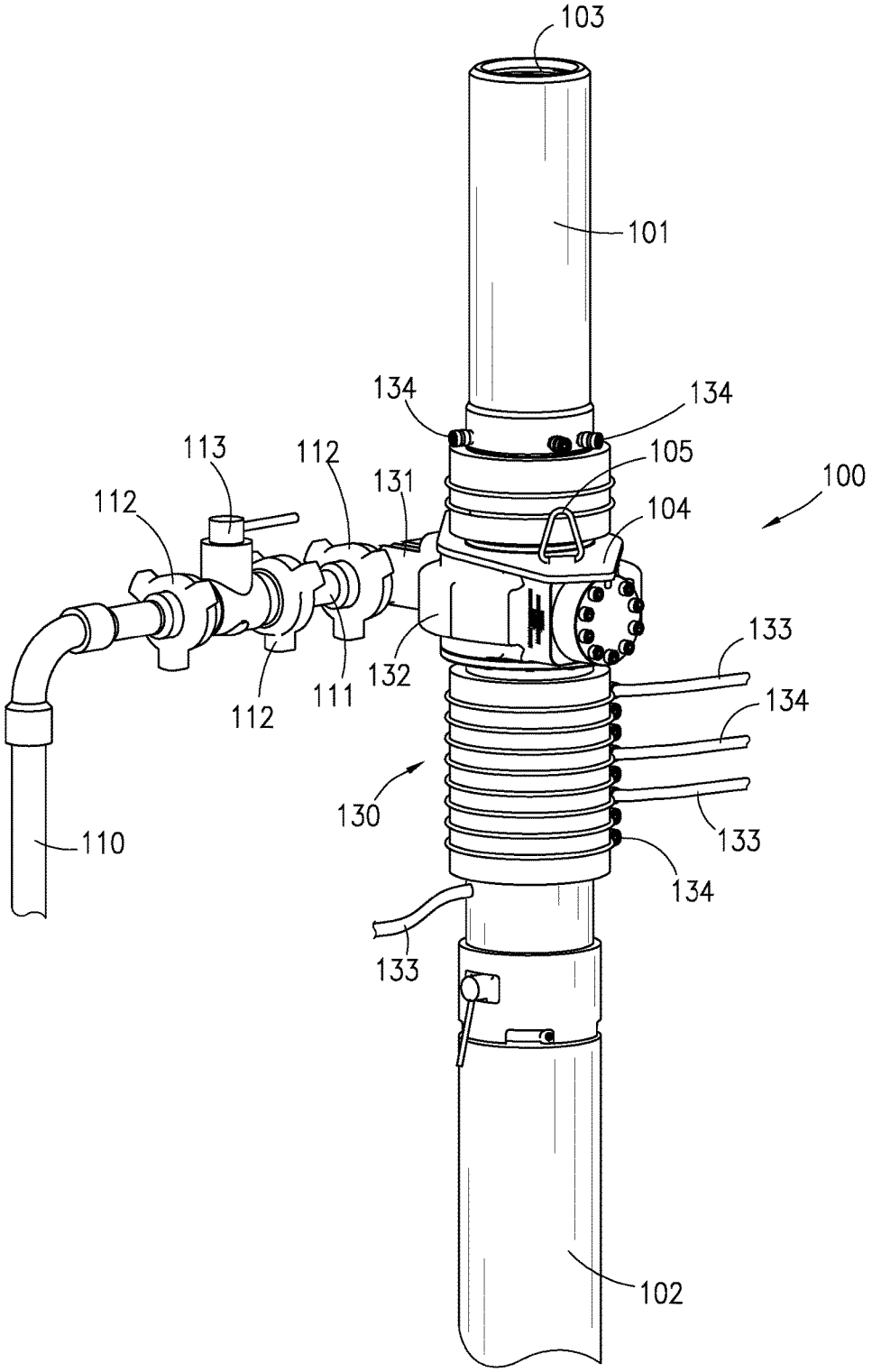
Fig. 1 PRIOR ART
FIG. 1 depicts a side perspective view of a conventional top-drive cement head assembly connected to a fluid conduit for supplying cement slurry or other fluid to said cement head.

Referring to the drawings, FIG. 1 depicts a side perspective view of a conventional top-drive cement head assembly 100 connected to a fluid conduit 110 for supplying cement slurry or other fluid to said cement head such as, for example, during a conventional cementing operation performed on an oil or gas well. Said cement head assembly 100 generally comprises upper body member 101 which can be attached to a lower connection of a rig's top drive unit or other equipment (not pictured) using threaded connection member 103. Lower body member 102 can be attached to other cementing components or equipment (such as, for example, dart or plug launching assemblies) well known to those having skill in the art.

As depicted in FIG. 1, conventional cement head assembly 100 further comprises torque plate 104 having eyelet or pad-eye 105. A chain, cable or other similar elongate member having sufficient tensile strength can be operationally attached to pad-eye 105 of torque plate 104 and secured to a rig component (such as a derrick support beam or other stationary object) to provide resistance to torque forces and prevent rotation of said torque plate 105. Application of torque force to cement head assembly 100 in a manner well known to those having skill in the art (typically from a top drive unit) permits rotation of rotating components of cement head assembly 100, while securing non-rotating components of said cement head assembly 100 against rotation.

It is to be observed that cement head assembly 100 typically includes other components operationally attached below lower body member 102; however, those components are not depicted herein for simplicity, but would normally be included as part of a typical cement head assembly configuration. Said lower components, in turn, can be operationally attached to a string of casing or other tubular members that can extend into a subterranean wellbore.

As depicted in FIG. 1, conventional cement head assembly 100 can beneficially include swivel assembly 130 well known to those having skill in the art. Said swivel assembly 130 includes outer swivel housing 132 having fluid inlet port receptacle 131 that is operationally attached to, and is in fluid communication with, fluid conduit 110. Swivel assembly 130 is provided, in part, to permit flow of cement slurry or other fluid flowing through fluid conduit 110 into cement head assembly 100 (and, ultimately, into a well bore situated below said cement head assembly 100), while simultaneously permitting rotation of certain components of cement head assembly 100.

Additionally, swivel assembly 130 permits flow of control fluid from a fluid supply/reservoir (not depicted in FIG. 1) to fluid-driven motors used to power actuators and/or other devices utilized for remote operation of various components of cement head assembly 100. Specifically, swivel assembly 130 permits hydraulic conduits 133, connected to ports 134, to supply hydraulic control fluid to rotating portions of cement head assembly 100, while preventing said hydraulic conduits 133 from becoming tangled or otherwise damaged during such rotation in a manner well known to those having skill in the art.

As noted above, fluid conduit 110 is typically utilized to connect a surface cement pumping system to a fluid inlet port of swivel assembly 130 of cement head assembly 100. Said fluid conduit 110, which can comprise a high-pressure hose, a swiveled flow-link chiksan or other flow line(s), is equipped with connectors 112 for connecting a distal end 111 of said fluid conduit 110 to a fluid inlet receptacle 131 of swivel assembly 130 of cement head assembly 100. As depicted in FIG. 1, said connectors 112 comprise WECO 1502-type hammer union; however, it is to be observed that said connectors 112 can comprise any number of different temporary connectors well known to those having skill in the art. In the configuration depicted in FIG. 1, valve 113 can be optionally installed between conduit 110 and cement head assembly 100 as a safety mechanism to selectively block fluid flow between said conduit 110 and cement head assembly 100, when desired.

During operation, cement head assembly 100 is frequently positioned at an elevated position out of reach of personnel working on a rig floor, thereby making it difficult for such personnel to easily access cement head assembly 100 in order to connect fluid conduit 110 to inlet port receptacle 131 of cement head assembly 100, and to disconnect said fluid conduit from said cement head assembly 100. In order to make such a connection, distal end 111 of said fluid conduit 110 (which can frequently include relatively heavy accessory equipment, like valve 113 and connectors 112) typically must be lifted to an elevated location in order to position said distal end 111 in close proximity to said cement head assembly 100. Thereafter, said distal end 111 of fluid conduit 110 must be securely coupled or connected to fluid inlet port receptacle 131 of said elevated cement head assembly 100 using a connector 112 in order to permit pressurized fluid (including, without limitation, heavy cement slurry) to flow through said fluid conduit 110 and into said cement head assembly 100 via swivel assembly 130.

During conventional cementing operations, distal end 111 of fluid conduit 110 (together with any ancillary equipment, such as valve 113) is raised using a rig's hoisting system from a rig floor to an elevated position in proximity to cement head assembly 100. In most instances, a cable of such hoisting system is attached at or near said distal end 111 of fluid conduit 110. Such cable is frequently attached at a sufficient distance from said distal end 111 so that fluid conduit 110 is permitted to swivel, while providing sufficient clearance for a person to grab and manipulate said fluid conduit 110 in order to securely attach said conduit 110 to said cement head assembly 100.

Personnel must also be hoisted off a rig floor, typically using a makeshift seat or harness attached to a winch or other lifting device, to position them in proximity to elevated cement head 100 and distal end 111 of conduit 110. When lifted in this manner, such personnel are at risk of falling and suffering serious injury or death. Moreover, such personnel typically must carry heavy hammers, wrenches and/or other tools used to facilitate connection of a connector 112 to cement head assembly 100, thereby increasing the risk of such items being accidentally dropped on personnel and/or equipment positioned on the rig floor below.

Figure 2:
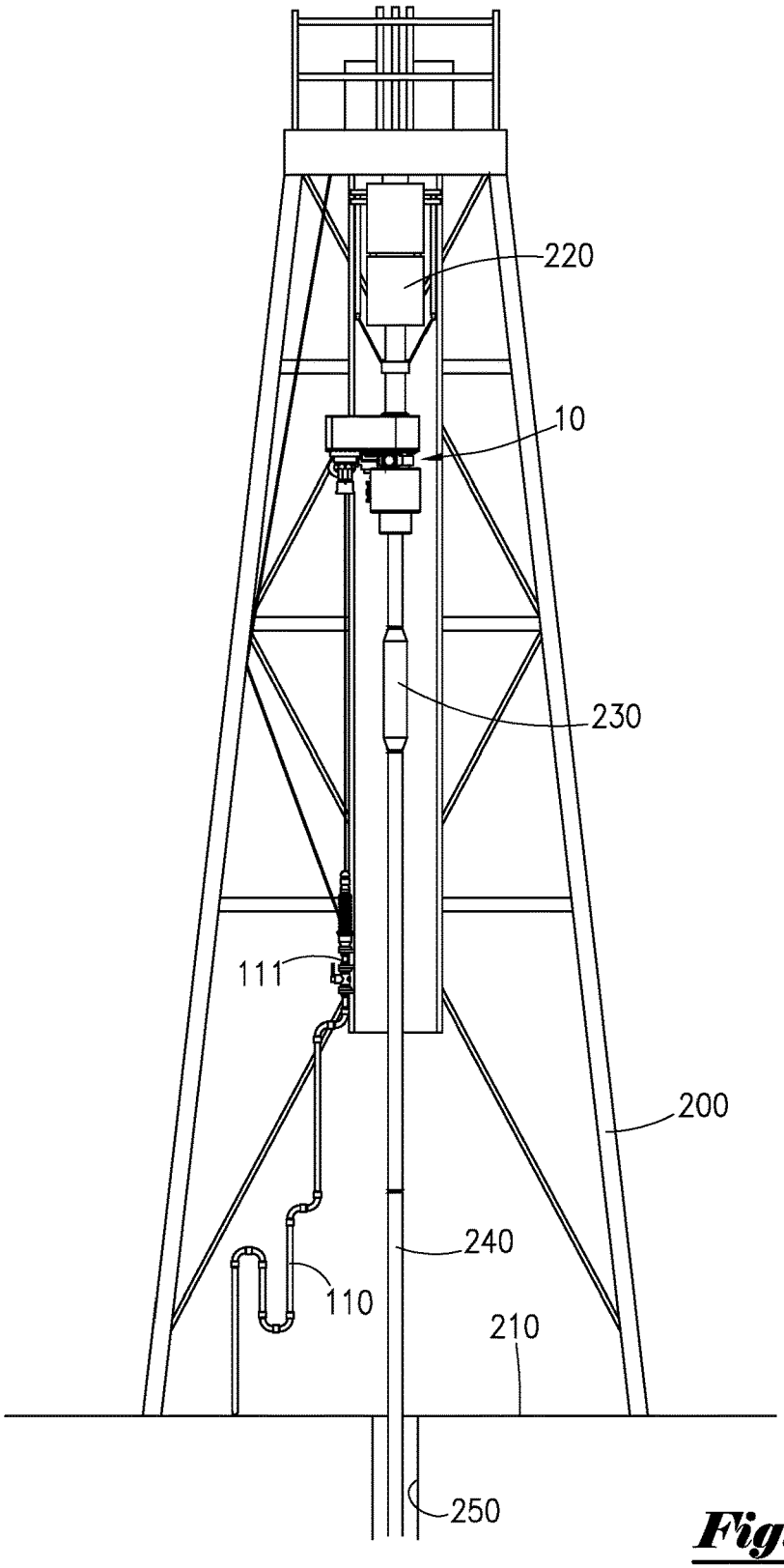
FIG. 2 depicts a side view of the automated connection assembly of the present invention installed at an elevated position above a drilling rig floor during the process of lifting the distal end of a cement slurry flow line to said automated connection assembly.

FIG. 2 depicts a side view of automated connection assembly 10 of the present invention positioned within drilling rig derrick 200. Automated connection assembly 10 is operationally attached to top drive unit 220, which can be raised and lowered within, and relative to, said derrick 200; in the configuration depicted in FIG. 2, automated connection assembly 10 is positioned in an elevated location within derrick 200 that is out of un-aided reach of personnel situated on rig floor 210. Cement head components 230 (such as dart or plug launchers and/or other equipment) are situated below and in fluid communication with said automated connection assembly 10, while a string of casing or other tubular goods 240 extend into a subterranean wellbore 250. As reflected in FIG. 2, distal end 111 of a cement slurry flow line 110 is depicted being lifted to said elevated position of said automated connection assembly 10.

Figure 2A:
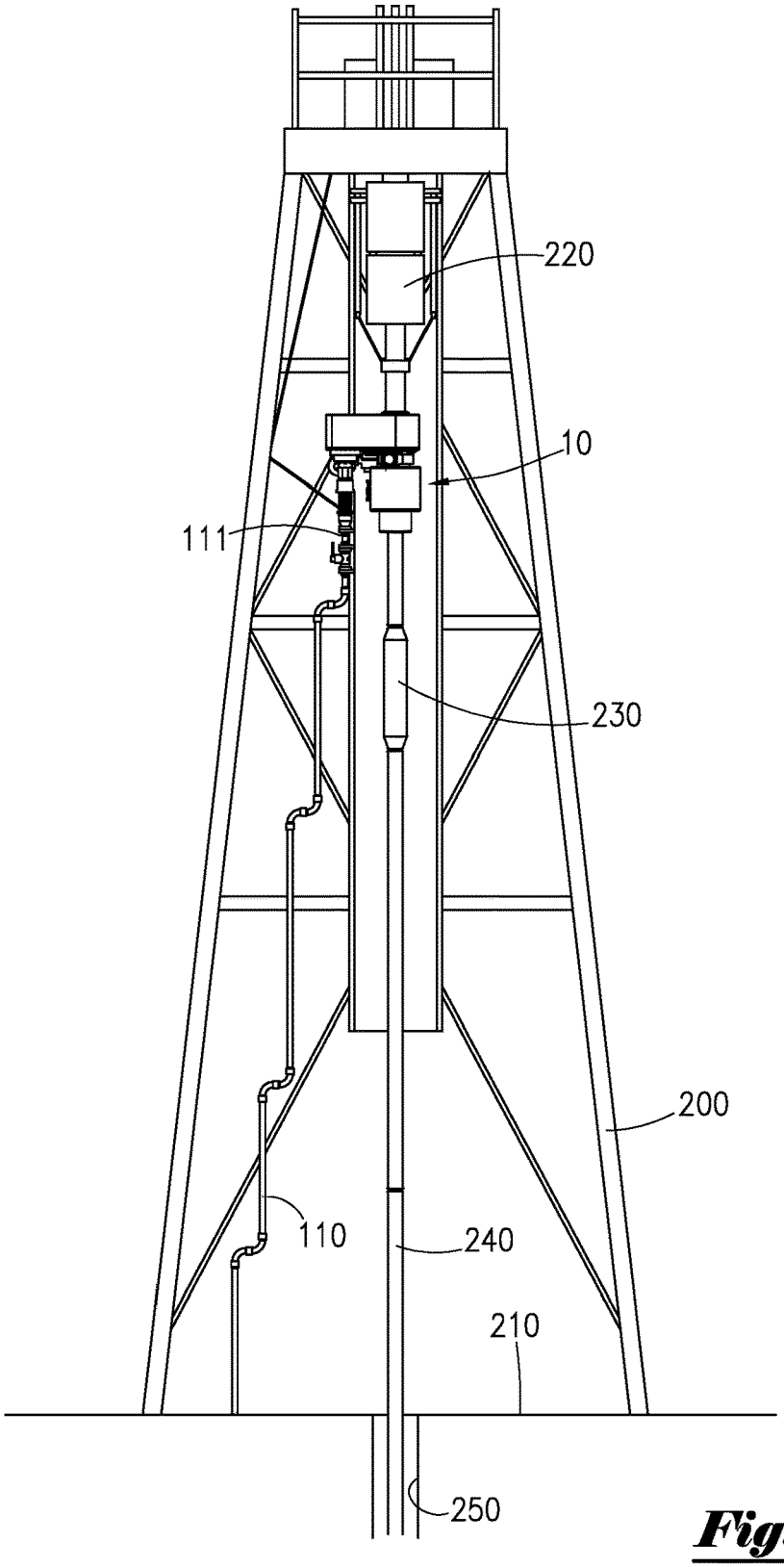
FIG. 2A depicts a side view of the automated connection assembly of the present invention positioned at an elevated position above a drilling rig floor following connection of the distal end of a cement slurry flow line to said automated connection assembly.

FIG. 2A also depicts a side view of automated connection assembly 10 of the present invention positioned at an elevated position within derrick 200 above drilling rig floor 210. Automated connection assembly 10 is operationally attached to movable top drive unit 220 which is raised within derrick 200. Cement head components 230 (such as dart or plug launchers and/or other equipment) are situated below and in fluid communication with said automated connection assembly 10, while a string of casing or other tubular goods 240 extend into a subterranean wellbore 250. In the configuration depicted in FIG. 2A, distal end 111 of flow line 110 is connected to, and in fluid communication with, said automated connection assembly 10.

Figure 3:
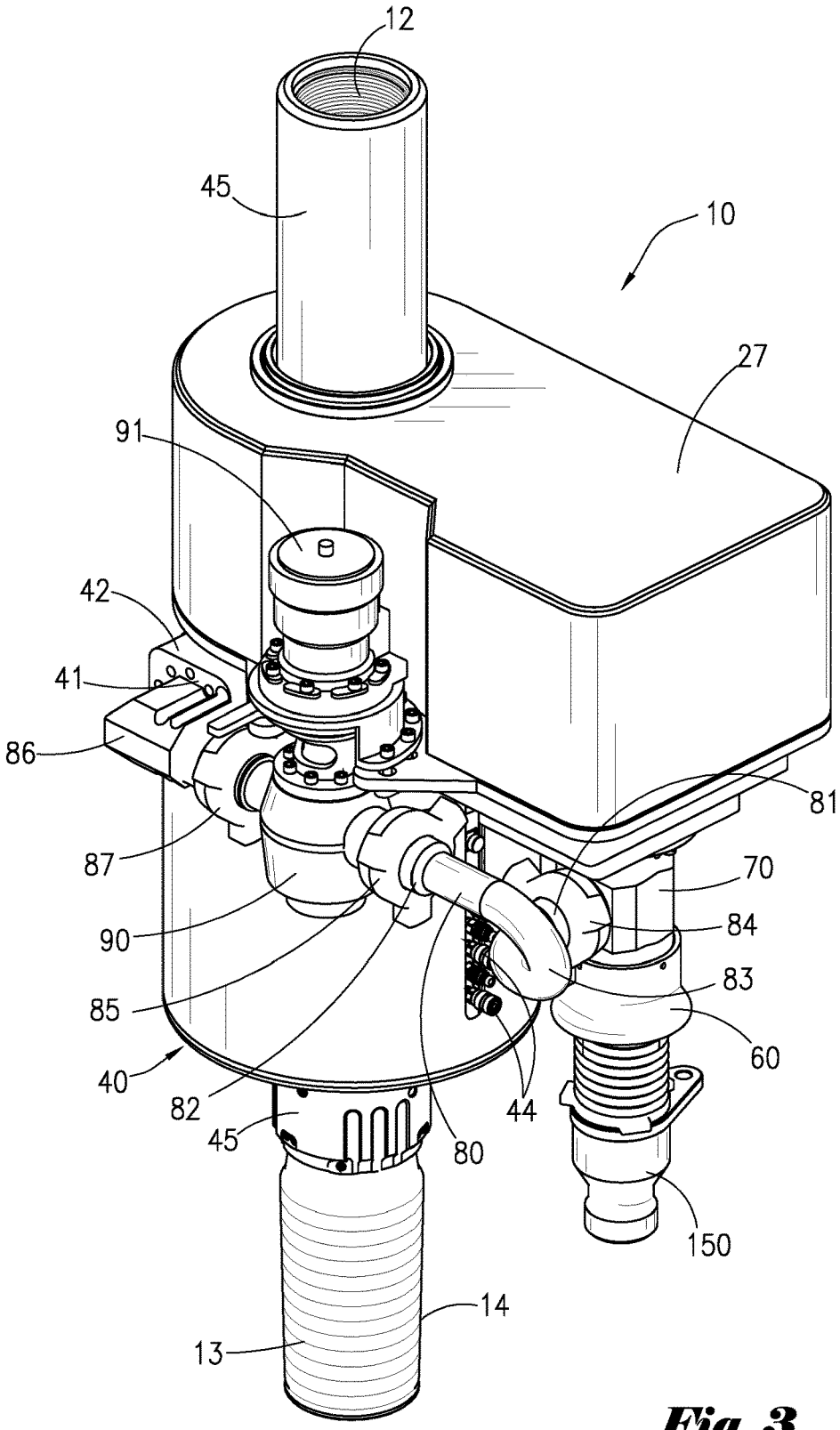
FIG. 3 depicts an overhead perspective view of a preferred embodiment of the automated connection assembly of the present invention.

FIG. 3 depicts an overhead perspective view of a preferred embodiment of automated connection assembly 10 of the present invention. Said automated connection assembly 10 further comprises swivel assembly 40, which performs many of the same operational functions as conventional fluid swivel assembly 130 depicted in FIG. 1. Swivel assembly 40 includes outer swivel housing 42 having fluid inlet port receptacle 41; swivel central mandrel 45 is rotatably disposed within said outer swivel housing 42. Swivel assembly 40 is provided, in part, to permit communication of cement slurry or other fluid flowing through an external fluid conduit into automated connection assembly 10 (and, ultimately, into a well bore situated below said automated connection assembly 10), while simultaneously permitting rotation of certain components of automated connection assembly 10.

Swivel central mandrel 45 has upper threaded connection member 12 which can be operationally attached to a mating lower connection member of a rig's top drive unit (such as, for example, top drive unit 220 depicted in FIGS. 2 and 2A). Upper threaded connection 12 is depicted as a female threaded connection, but it is to be observed that said upper threaded connection 12 could alternatively be a male threaded connection member or other type of connection member allowing for secure operational attachment of swivel central mandrel 45 to such a top drive unit or other rig lifting assembly.

Additionally, swivel assembly 40 permits flow of control fluid from a fluid supply/reservoir (not depicted in FIG. 3) to fluid-driven motors used to power actuators and/or other devices utilized for remote operation of various equipment situated below automated connection assembly 10 (such as, for example, cement head components 230 depicted in FIGS. 2 and 2A). Specifically, swivel assembly 40 permits hydraulic conduits to be connected to ports 44 in order to supply hydraulic control fluid to rotating components of automated connection assembly 10, while preventing said hydraulic conduits from becoming tangled or otherwise damaged during such rotation thereof.

Still referring to FIG. 3, lower connection member 13 is disposed on swivel central mandrel 45. Said lower connection member 13 provides a means for operational attachment of said swivel central mandrel 45 to equipment or components situated below said automated connection assembly 10 (such as, for example, cement head components 230 and/or string of casing or other tubular goods 240 depicted in FIGS. 2 and 2A). Lower threaded connection 13 is depicted as a male threaded connection having external threads 14 to facilitate secure connection to, and support of, relatively heavy equipment and/or pipe situated below automated connection assembly 10. However, it is to be observed that said lower threaded connection 13 could alternatively be a female threaded connection member or other type of connection member allowing for secure operational attachment of automated connection assembly 10 to equipment or components situated below said automated connection assembly 10 (such as, for example, cement head components and/or string of casing or other tubular goods).

Downwardly facing flared entry guide 60 is connected to fluid connection hub 70. Flow conduit 80 has a first end 81 and a second end 82; as depicted in FIG. 3, said flow conduit 80 includes curved or bent section 83 to more efficiently utilize available space. Connector 84 connects first end 81 to fluid connection hub 70, while connector 85 connects second end 82 to plug valve 90 having actuation assembly 91. Said actuation assembly 91 can comprise a hydraulic, pneumatic or electronic actuation assembly for opening and closing plug valve 90 that can be beneficially remotely operated from a distance away from said automated connection assembly 10. Flow elbow conduit 86 is connected to plug valve 90 using connector 87; said flow elbow is, in turn, connected to fluid inlet receptacle 41 of swivel outer housing 42. Male stinger member 150, described in more detail below, is partially received within flared entry guide 60. Housing cover 27 is also provided on automated connection assembly 10.

Figure 4:
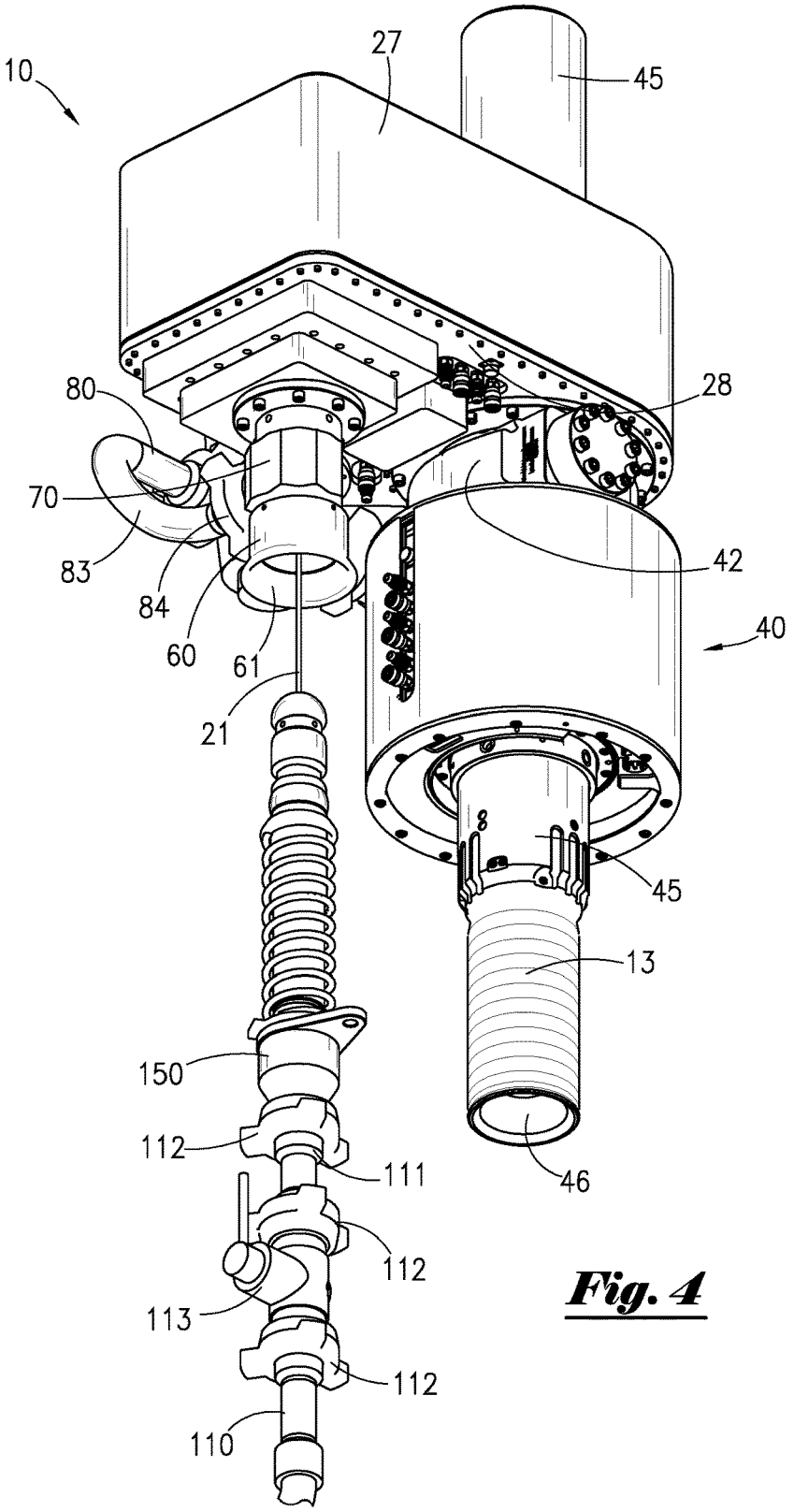
FIG. 4 depicts a lower perspective view of a preferred embodiment of the automated connection assembly of the present invention.

FIG. 4 depicts a lower perspective view of automated connection assembly 10 of the present invention. Swivel assembly 40 includes outer swivel housing 42, while swivel central mandrel 45 is rotatably disposed within said outer swivel housing 42. The upper portion of swivel central mandrel 45 can be operationally attached to a lower connection member of a rig's top drive unit (via upper threaded connection 12, not visible in FIG. 4). Lower connection member 13, disposed near the bottom portion of swivel central mandrel 45, provides a means for operational attachment of said swivel central mandrel 45 to equipment or components situated below said automated connection assembly 10 (such as, for example, cement head components and/or string of casing or other tubular goods). Central flow bore 46 extends through at least a portion of said swivel central mandrel 45. Transverse flow ports extend through swivel central mandrel 45, such that central flow bore 46 is in fluid communication with swivel housing 42.

Downwardly facing flared entry guide 60 having central bore 61 is connected to fluid connection hub 70. In the configuration depicted in FIG. 4, male stinger member 150 is connected to distal end 111 of fluid conduit 110 using connector 112. Valve 113 is optionally installed in line within conduit 110 using connectors 112 as a safety mechanism to selectively block fluid flow between said conduit 110 automated connection assembly 10, when desired. As depicted in FIG. 4, said connectors 112 comprise WECO 1502-type hammer unions; however, it is to be observed that said connectors 112 can comprise any number of different temporary connectors well known to those having skill in the art.

Still referring to FIG. 4, cable 21 is attached to the distal end of stinger member 150 and serves to connect said stinger member 150 with automated connection assembly 10. The longitudinal axis of elongate stinger member 150 is generally aligned with said cable 21, and the longitudinal axis of central bore 61 of flared entry guide 60. Substantially planar winch support base 28 is disposed over swivel assembly 40, while housing cover 27 is disposed over said winch support base 28.

Figure 5:
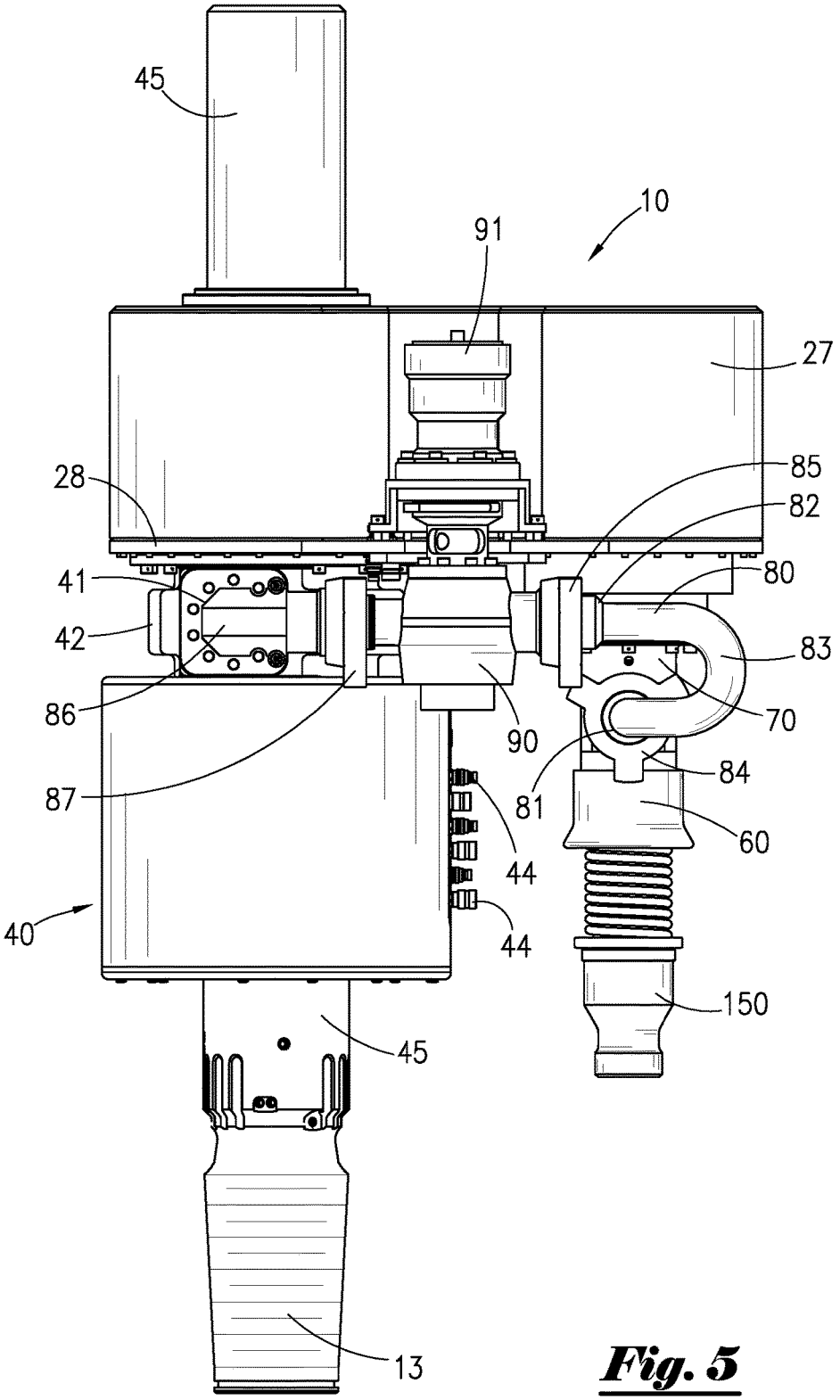
FIG. 5 depicts a side view of a preferred embodiment of the automated connection assembly of the present invention.

FIG. 5 depicts a side view of a preferred embodiment of automated connection assembly 10 of the present invention. Said automated connection assembly 10 generally comprises swivel assembly 40 having outer swivel housing 42 and inlet port receptacle 41. Swivel central mandrel 45 is rotatably disposed within said outer swivel housing 42. The upper portion of swivel central mandrel 45 has upper threaded connection member 12 (not visible in FIG. 5) which can be operationally attached to a mating lower connection member of a rig's top drive unit.

Swivel assembly 40 permits flow of control fluid from a fluid supply/reservoir (not depicted in FIG. 5) to fluid-driven motors used to power actuators and/or other devices utilized for remote operation of various equipment situated below automated connection assembly 10. Hydraulic conduits can be connected to control fluid ports 44 in order to supply hydraulic control fluid to rotating components of automated connection assembly 10. Lower connection member 13 is disposed on the lower portion of swivel central mandrel 45 and provides a means for operational attachment of said swivel central mandrel 45 to equipment or components situated below said automated connection assembly 10 (such as, for example, cement head components and/or casing or other tubular goods).

Downwardly facing flared entry guide 60 is connected to fluid connection hub 70. Flow conduit 80 has a first end 81, second end 82 and curved or bent section 83. Connector 84 connects first end 81 to fluid connection hub 70, while connector 85 connects second end 82 to plug valve 90 having actuation assembly 91. Flow elbow conduit 86, which is connected at one end to plug valve 90 using connector 87, is also connected to fluid inlet receptacle 41 of swivel outer housing 42. Male stinger member 150 is partially received within central bore (not visible in FIG. 5) of flared entry guide 60. Substantially planar winch support base 28 is disposed over swivel assembly 40, while housing cover 27 is disposed over said winch support base 28.

Figure 6:
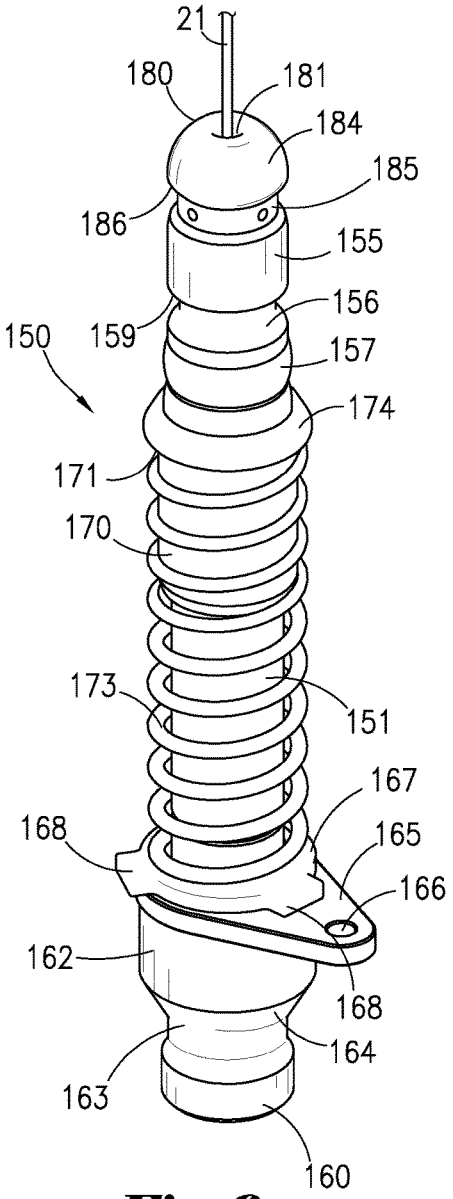
FIG. 6 depicts an overhead perspective view of a stinger member of the present invention.
Figure 7:
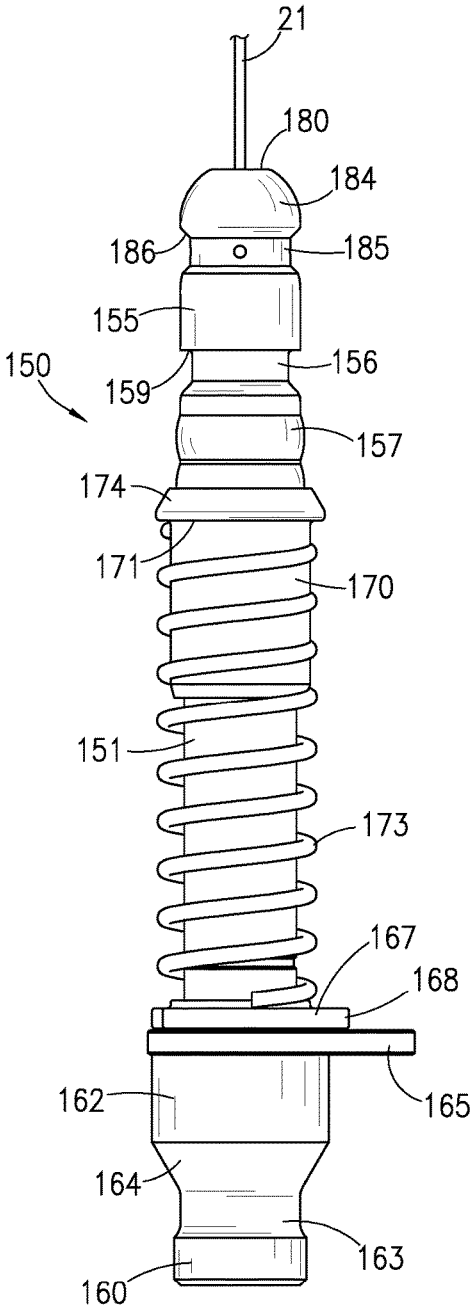
FIG. 7 depicts a side view of a stinger member of the present invention.

FIG. 6 depicts an overhead perspective view of a stinger member 150 of the present invention, while FIG. 7 depicts a side view of said male stinger member 150. Said male stinger member 150 generally comprises elongate central body member 151 having nose section 155. Section of reduced outer diameter 156 defines downwardly facing shoulder surface 159, while rounded profile section 157 has a substantially curved or convex outer surface. Base member 160 is threadedly connected to central body member 151. Said base member 160 has body section 162 and section of reduced outer diameter 163 that defines downwardly facing tapered shoulder surface 164. Base plate 167 having adjustment lugs 168 is threadedly received on threads disposed along a portion of body member 151. Plate member 165 having aperture 166 is disposed between body section 162 of base member 160, and adjustable base plate 167.

Substantially cylindrical valve sleeve member 170 is slidably disposed over central body member 151. Valve sleeve member 170 has upset section 174 defining downwardly facing bias shoulder surface 171. Spring 173 is disposed along the outer surface of body member 151 between adjustable base plate 167 and upset section 174 of valve sleeve 170; said spring 173 acts on bias shoulder surface 171 to force or bias movable valve sleeve in a direction away from base plate 167.

Cap member 180 having a central through bore 181 is threadedly connected to nose section 155 of central body member 151. A portion of cable 21 extends through central through bore 181 of cap member 180 and is secured to male stinger member 150. In a preferred embodiment, said cap member 180 also has section of reduced outer diameter 185, defining downwardly facing tapered shoulder surface 186, as well as rounded or curved outer surface 184.

Figure 8:
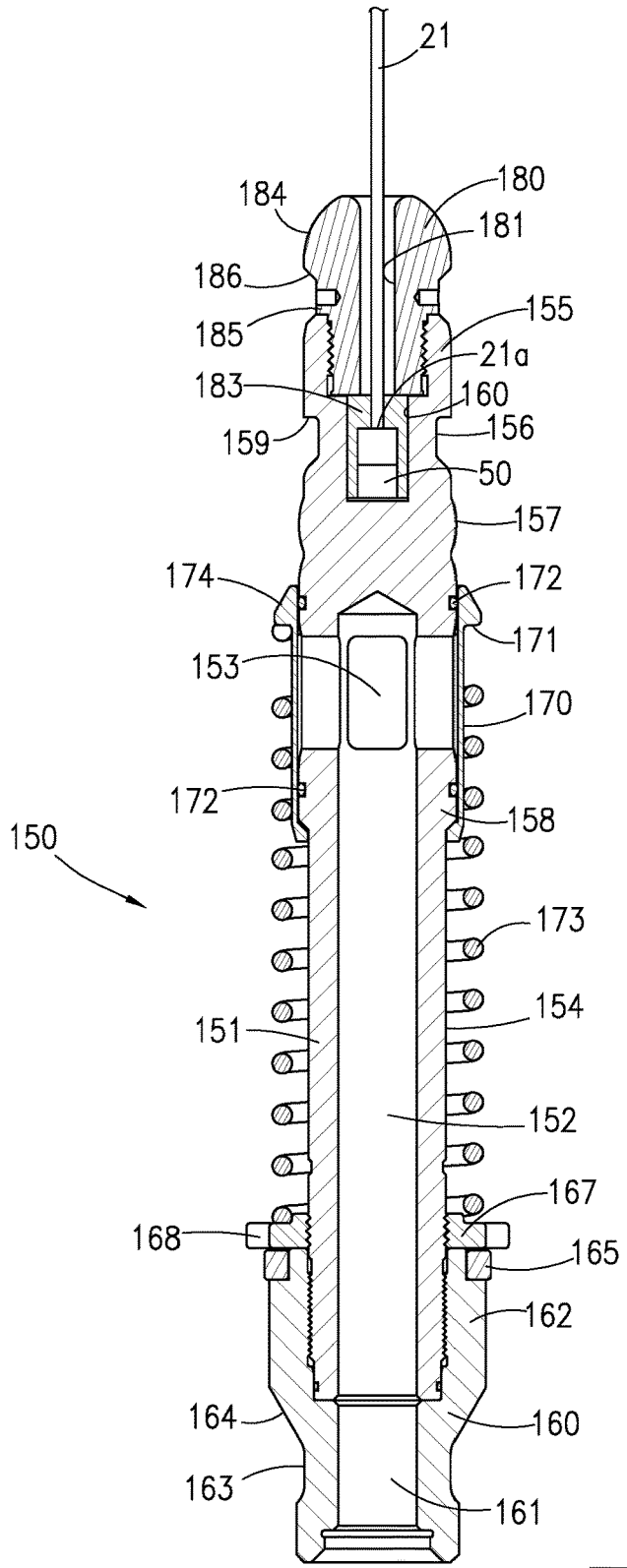
FIG. 8 depicts a side sectional view of a stinger member of the present invention.

FIG. 8 depicts a side sectional view of male stinger member 150 of the present invention. Said male stinger member 150 generally comprises elongate central body member 151 having outer surface 154 and inner central flow bore 152, as well as nose section 155. Transverse flow bores or ports 153 are disposed at or near the upper end of inner central flow bore 152 and extend radially outward through body member 151; said body member 151 can have an upset area of increased outer diameter in the vicinity of said transverse ports 153. Section 156 having reduced outer diameter defines downwardly facing shoulder surface 159, while rounded profile section 157 has a substantially curved or convex outer surface.

Base member 160 having central flow bore 161 is threadedly connected to central body member 151; in this configuration, central flow bore 161 is substantially aligned with central flow bore 152 of central body member 151. Base member 160 has body section 162 and section 163 having reduced outer diameter that defines downwardly facing tapered shoulder surface 164.

Base plate 167 having adjustment lugs 168 is threadedly received on threads disposed along a portion of outer surface 154 of central body member 151. Rotation of base plate 167 within said threads causes said base plate to travel along the longitudinal axis of said body member 151. Plate member 165 is disposed between body section 162 of base member 160, and adjustable base plate 167.

A substantially cylindrical valve sleeve member 170 is slidably disposed over central body member 151 in general, and upset section 158 of body member 151, in particular. Valve sleeve member 170 has upset section 174 defining downwardly facing bias shoulder surface 171. Rubber or elastomeric sealing o-rings 172 form a fluid pressure seal between the outer surface of upset section 158 and the inner surface of valve sleeve 170. Spring 173 is disposed along the outer surface of body member 151 between adjustable base plate 167 and upset section 174 of valve sleeve 170; said spring 173 acts on bias shoulder surface 171 to force movable valve sleeve away from base plate 167 and bias said valve sleeve 170 in a normally closed position, blocking or obstructing transverse flow ports 153.

Cable end stop fitting 50 is fixedly attached to distal end 21*a* of cable 21. Said cable end stop fitting 50 is disposed within internal recess 160 formed in nose section 155 of central body member 151. Spacer spool member 183 is disposed over cable end stop fitting 50. Cap member 180 having central through bore 181 and threaded section 182 is threadedly connected to nose section 155 of central body member 151, thereby securing said cable end stop fitting 50 and spacer spool member 183 in place. Cable 21 extends through central through bore 181 of cap member 180. In a preferred embodiment, said cap member 180 also has section of reduced outer diameter 185, as well as rounded or curved outer surface 184. Tapered shoulder surface 186 is formed between area or section of reduced outer diameter 185 and rounded outer surface 184 of cap member 180.

Figure 9:
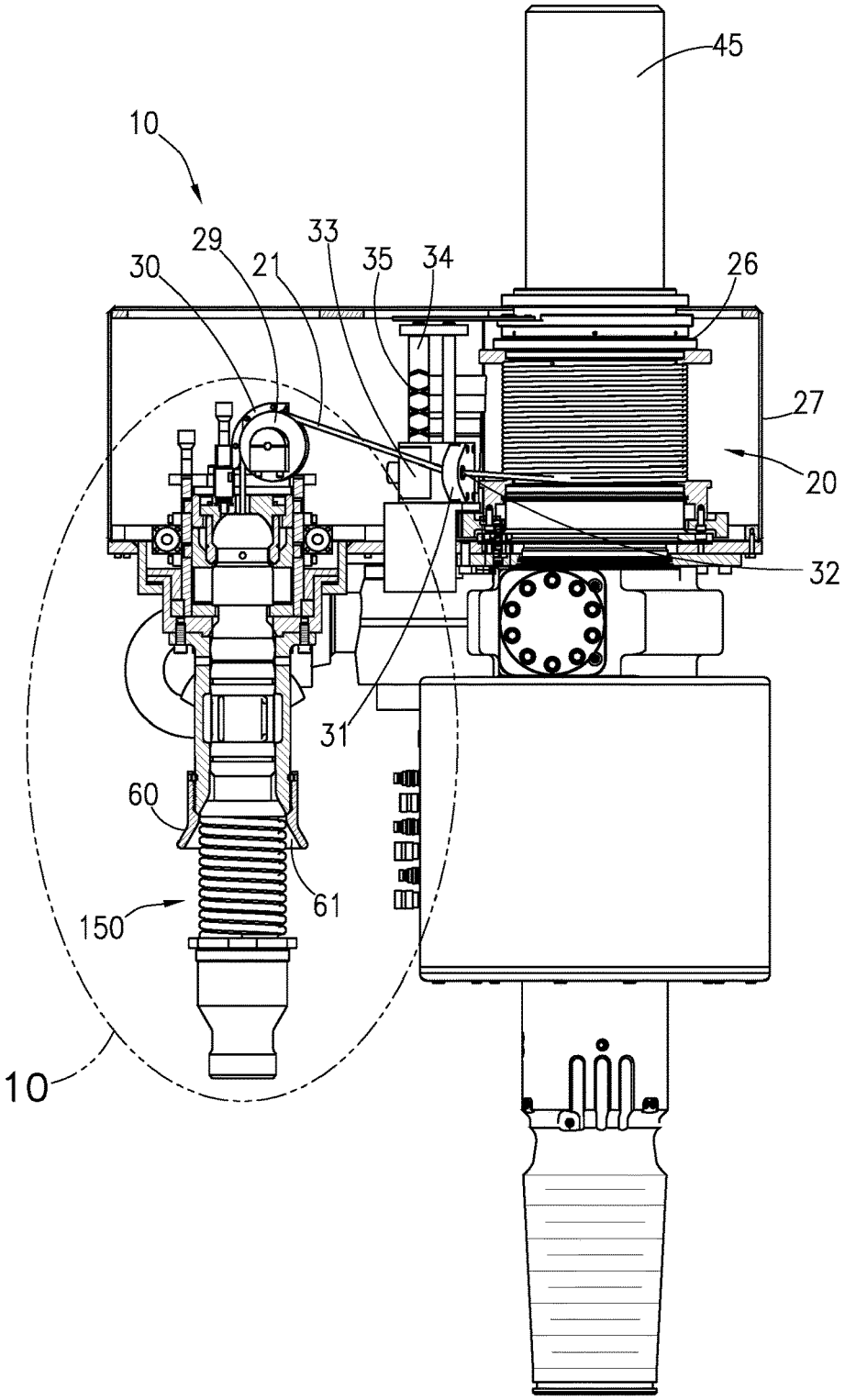
FIG. 9 depicts a side, partial sectional view of a stinger member engaged with a receptacle assembly of the present invention.
Figure 10:
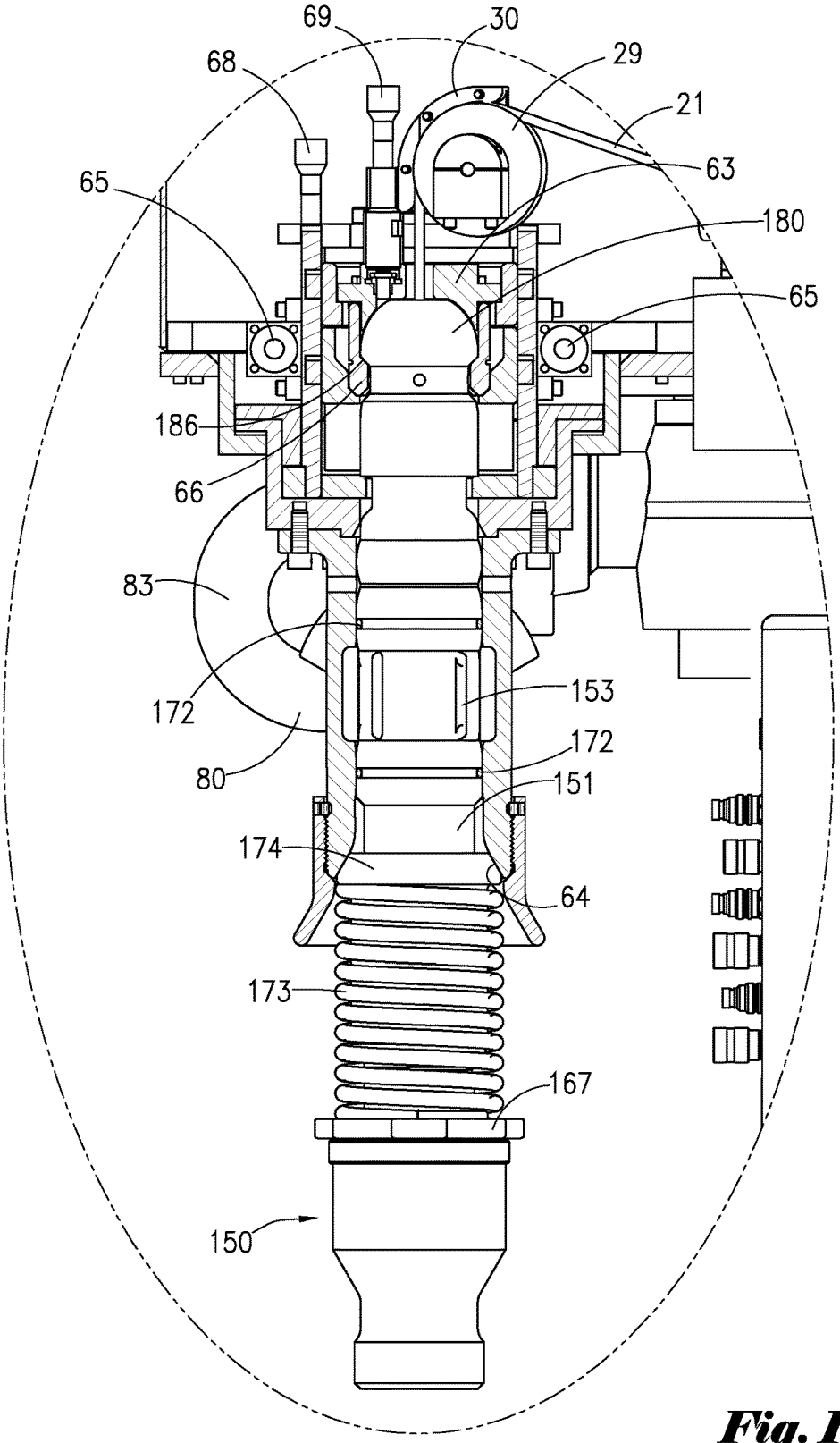
FIG. 10 depicts a detailed view of the highlighted area of FIG. 9.

FIG. 9 depicts a side, partial sectional view of a male stinger member 150 engaged with automated connection assembly 10 of the present invention, while FIG. 10 depicts a detailed view of the highlighted area of FIG. 9. In the views depicted in FIGS. 9 and 10, automated connection assembly 10 comprises a winch assembly disposed inside protective housing cover 27. Winch assembly 20 generally has cable 21 partially spooled on winch drum 26, which is itself rotatably disposed around swivel central mandrel 45. A portion of cable 21 is unspooled from winch drum 26, passes through level-wind guide 31, and over pulley 29 having pulley guide 30. In a preferred embodiment, pulley guide 30 keeps tension on cable 21 as it passes over pulley 29. As depicted in FIGS. 9 and 10, a portion of male stinger member 150 is received within bore 61 of entry guide 60 of automated connection assembly 10.

Figure 11:
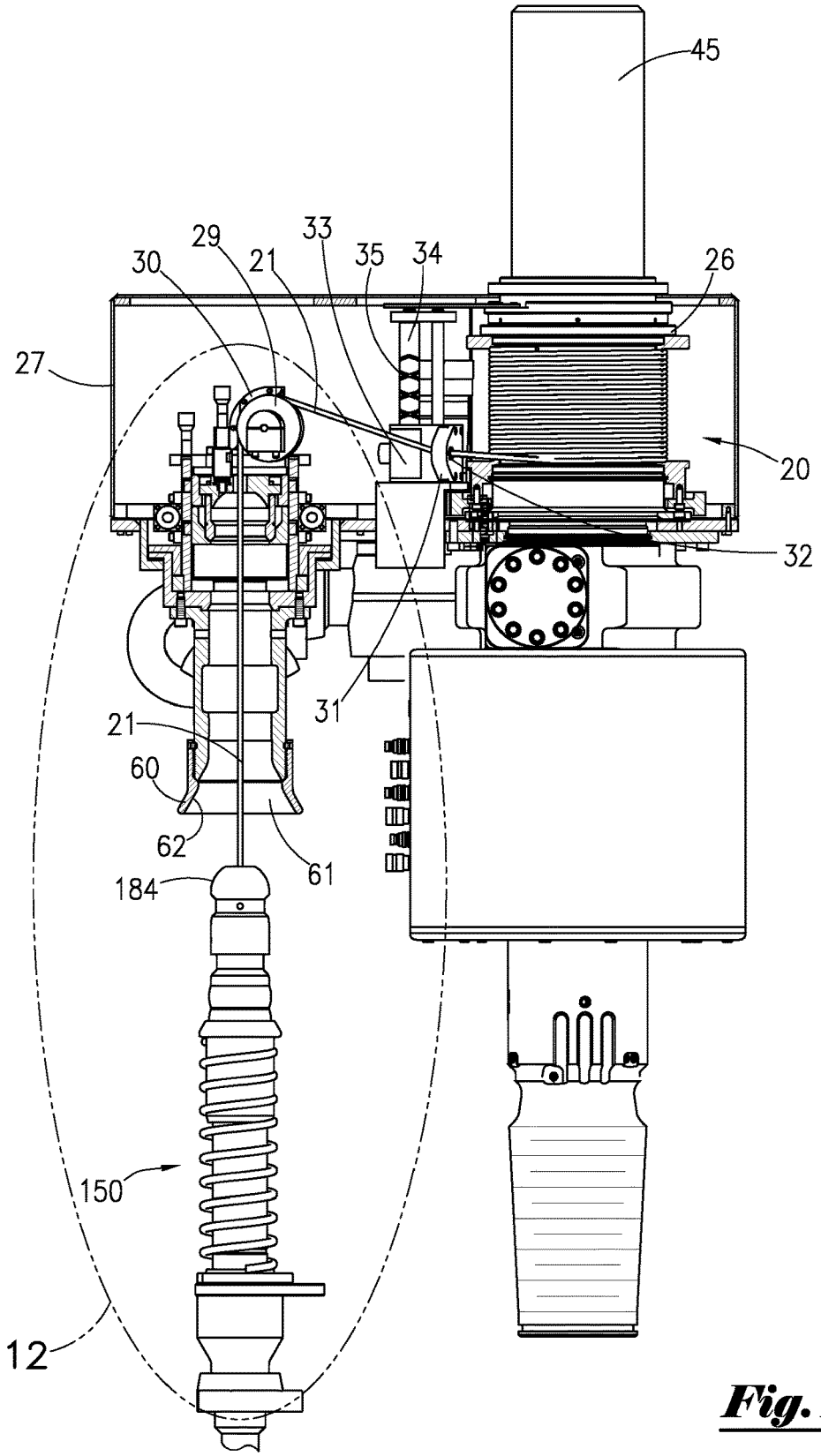
FIG. 11 depicts a side, partial sectional view of the automated connection assembly of the present invention (including a stinger member) during the process of lifting and connecting said stinger member to a receptacle assembly of the present invention.
Figure 12:
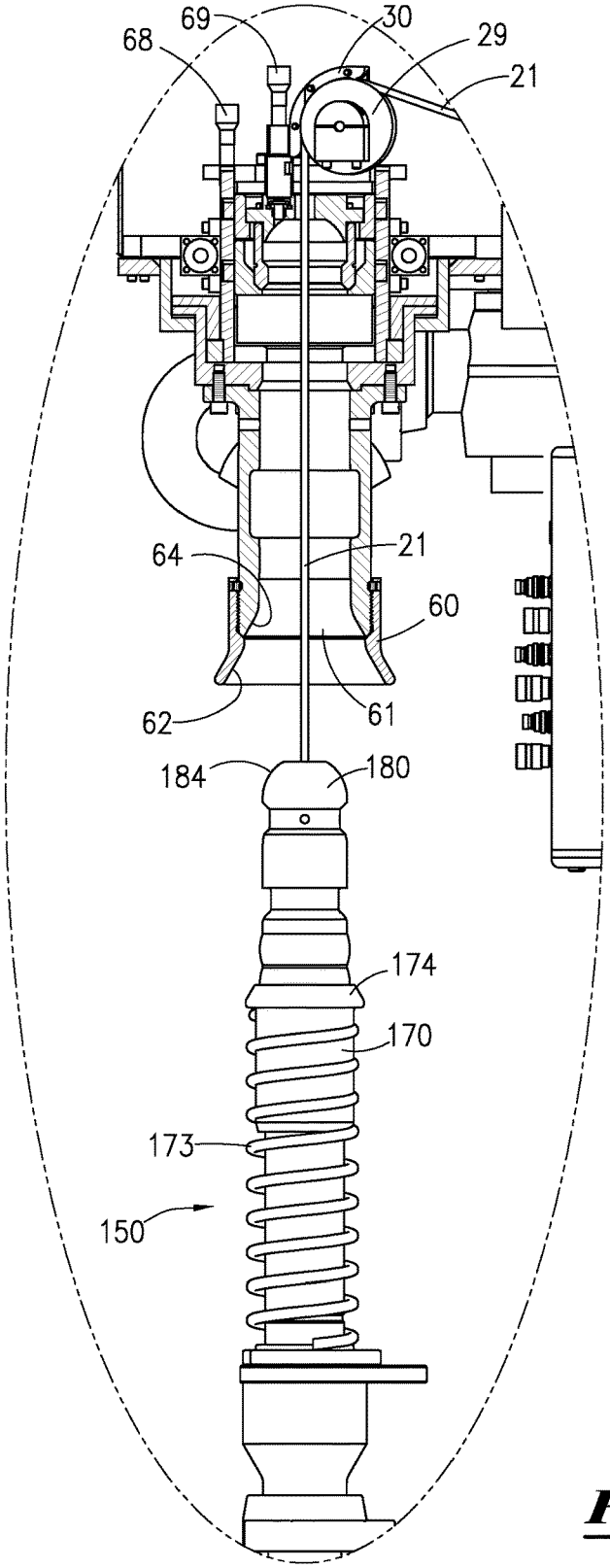
FIG. 12 depicts a detailed view of the highlighted area of FIG. 11.

FIG. 11 depicts a side, partial sectional view of automated connection assembly 10 of the present invention during the process of lifting male stinger member 150 into engagement with said automated connection assembly 10. FIG. 12 depicts a detailed view of the highlighted area of FIG. 11. As in FIGS. 9 and 10, automated connection assembly 10 comprises a winch assembly disposed inside protective housing cover 27; said housing cover 27 protects components contained therein from exposure to harmful weather or environmental factors, as well as from inadvertent collision or contact with other objects. Winch assembly 20 generally has cable 21 partially spooled on winch drum 26, which is itself rotatably disposed around swivel central mandrel 45. A portion of cable 21 is unspooled from winch drum 26, passes through level-wind guide 31, and over pulley 29 having pulley guide 30. As depicted in FIGS. 11 and 12, male stinger member 150 is not received within bore 61 of entry guide 60 of automated connection assembly 10.

Referring to FIGS. 9 and 11, level wind guide 31 comprises plate-like member having aperture 32. Level wind guide 31 is attached to level-wind spool 33 which is movably disposed along the outer surface of spindle 34 having helical guide grooves 35. Rotation of spindle 34 about its central longitudinal axis causes spool member 33 to travel within helical guide grooves 35 which, in turn, causes said spool member 33 and attached level wind guide 31 to travel back and forth along the length of spindle 34. In this manner, level wind guide 31 ensures even and level winding of cable 21 around the outer surface of winch drum 26 (and unwinding of said cable 21 from said winch drum 26).

Figure 13:
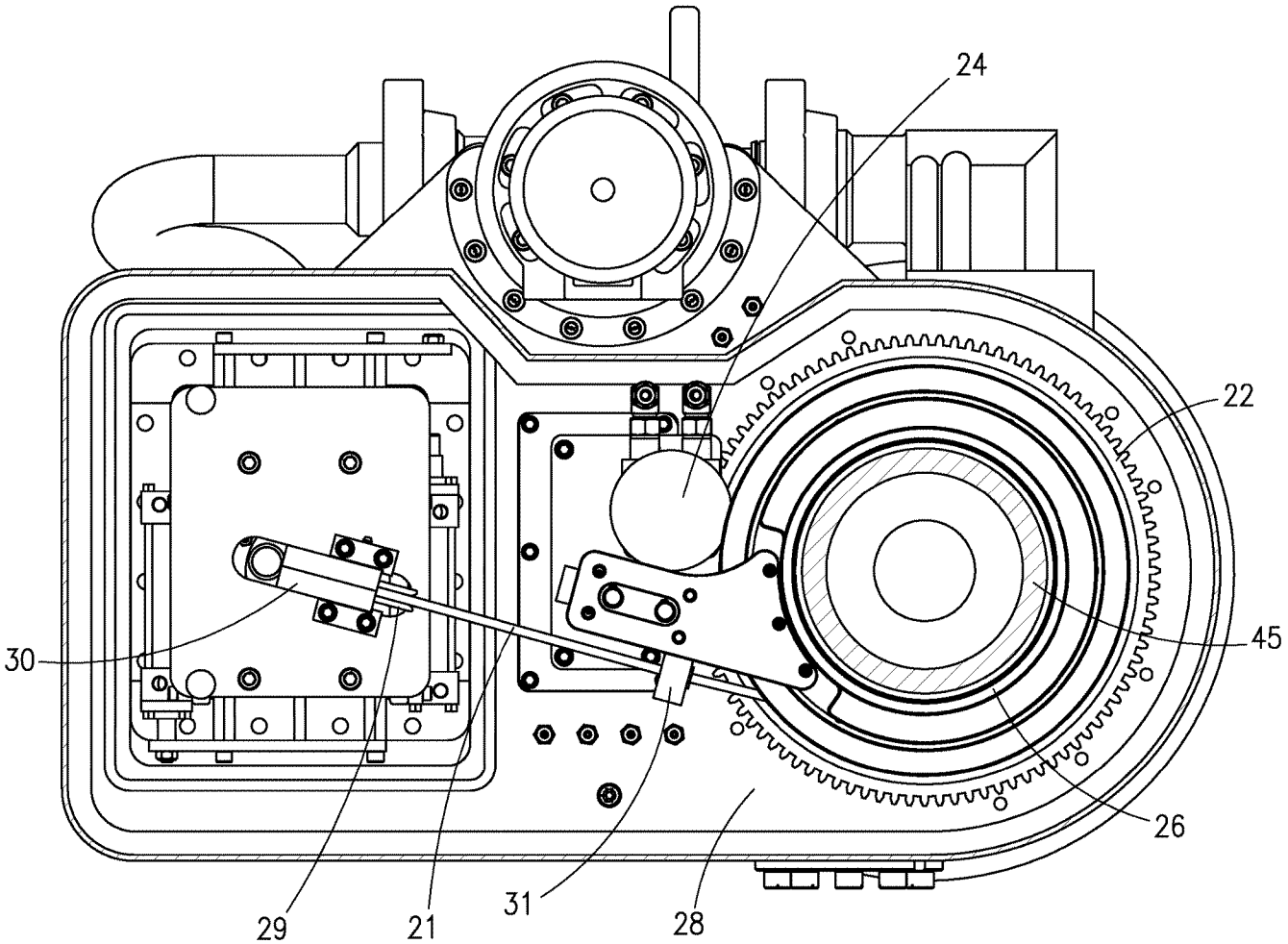
FIG. 13 depicts an overhead and partial sectional view of the automated connection assembly of the present invention.

FIG. 13 depicts an overhead partial sectional view of automated connection assembly 10 of the present invention with housing cover 27 removed. Cable 21 is partially spooled on winch drum 26, which is rotatably disposed around the outer surface of swivel central mandrel 45. Winch drive spur gear 22 is operationally attached to winch drum 26. A portion of cable 21 is unspooled from winch drum 26, passes through level-wind guide 31, and over pulley 29 having pulley guard 31.

Winch drive motor 24, operationally mounted on winch support base 28, has a drive shaft connected to a drive gear which, in turn, engages with spur gear 22. Winch drive motor 24 drives said drive gear which engages with spur gear 22 to rotate winch drum 26 about a rotational axis that is oriented substantially parallel to the longitudinal axis of swivel central mandrel 45. In a preferred embodiment, said drive motor 24 is hydraulically powered; however, it is to be observed that said drive motor 24 can be beneficially powered using another power source such as, by way of illustration, pneumatic or electrical power.

Figure 14:
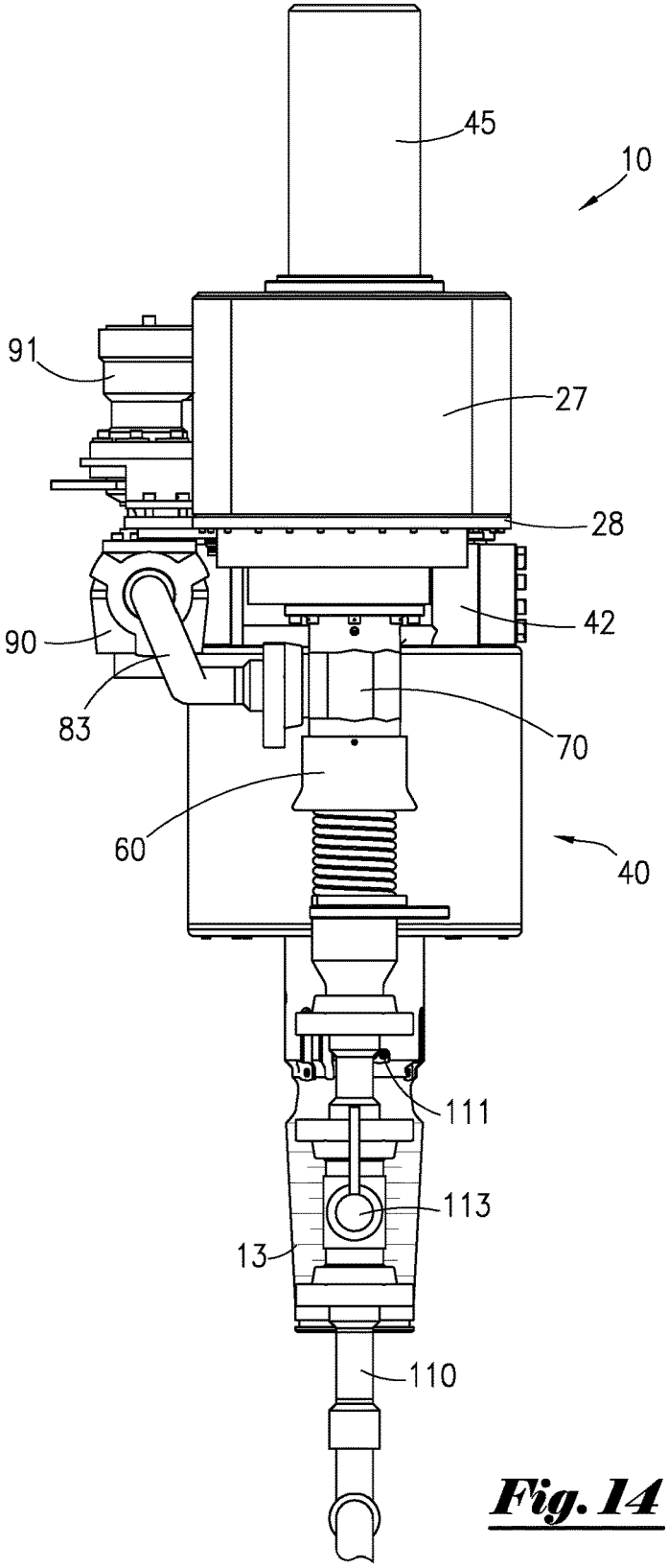
FIG. 14 depicts a side view of a fluid conduit connected to automated connection assembly of the present invention.

FIG. 14 depicts a side view of stinger member 150 engaged with a receptacle assembly of the present invention. Said automated connection assembly 10 generally comprises swivel assembly 40 having outer swivel housing 42. Swivel central mandrel 45 is rotatably disposed within said outer swivel housing 42. Lower connection member 13 is disposed on the lower portion of swivel central mandrel 45 and provides a connection member for operational attachment of said swivel central mandrel 45 to equipment or components situated below said automated connection assembly 10 (such as, for example, cement head components and/or casing or other tubular goods).

Downwardly facing flared entry guide 60 is connected to fluid connection hub 70. A flow conduit having curved section 83 extends between fluid connection hub and plug valve 90 having actuation assembly 91. Male stinger member 150, connected to distal end 111 of fluid conduit 110 equipped with valve 113, is partially received within central bore (not visible in FIG. 14) of flared entry guide 60. Substantially planar winch support base 28 is disposed over swivel assembly 40, while housing cover 27 is disposed over said winch support base 28.

During operation, automated connection assembly 10 of the present invention can be positioned at a desired location such as, for example, a location elevated above a drilling rig floor, out of reach of personnel positioned on said rig floor, as depicted in FIG. 2. Distal end 21*a* of cable 21 can be operationally attached to a male stinger member 150, as depicted in FIG. 8. A desired length of cable 21 can be unwound from winch drum 26 of winch assembly 20, thereby allowing male stinger member 150 to be positioned on a rig floor or other convenient location for personnel to access and manipulate said male stinger member 150.

Once positioned at the rig floor or other convenient location, male stinger member 150 can be attached to the outlet of a fluid conduit 110 used for pumping cement slurry and/or other fluid to an elevated cement head (such as, for example, a chiksan line or fluid conduit 110 depicted in FIG. 1). Referring to FIG. 4, male stinger member 150 can be connected to distal end 111 of fluid conduit 110 using connector 112. Valve 113 can optionally be installed in line within conduit 110 using connectors 112 as a safety mechanism to selectively block fluid flow between said conduit 110 automated connection assembly 10, when desired. As depicted in FIG. 2, with said stinger member 150 connected to conduit 110, cable 21 can be selectively rewound or taken up onto winch drum 26 of winch assembly 20, thereby causing stinger member 150 and the attached distal end of conduit 110 to be raised from a rig floor or other convenient staging area toward automated connection assembly 10.

Referring to FIGS. 11 and 12, cable 21 can continue to be rewound or taken up onto winch drum 26 of winch assembly 20, thereby causing stinger member 150 and the attached distal end of conduit 110 to move closer to automated connection assembly 10. As stinger member 150 approaches automated connection assembly 10, the longitudinal axis of said elongate male stinger member 150 is generally aligned with the longitudinal axis of said cable 21, as well as the longitudinal axis of central bore 61 of flared entry guide 60. As said cable 21 continues pull stinger member 150 upward, said stinger member 150 enters into bore 61 of flared entry guide 60; rounded outer surface 184 of cap member 180 can cooperate with tapered inner surface 62 of flared entry guide 160 to reduce frictional forces, re-orient alignment between stinger member 150 and bore 61, and encourage deeper penetration of stinger member 150 in said bore 61.

Referring to FIGS. 9 and 10, continued winding of cable 21 on winch drum 26 of winch assembly 20 results in male stinger member 150 being received into bore 61 until cap member 180 of male stinger member 150 contacts end stop member 63. Once in this position, fluid powered cylinders 65 can be remotely actuated from a location away from said automated connection assembly, thereby locking collet fingers 66 in place and preventing radially outward movement of said collet fingers 66. In this locked position, collet fingers 66 recess into area of reduced diameter 185 of cap member 180 of male stinger member 150; said collet fingers act against tapered shoulder surface 186 of cap member 180 of stinger member 150, thereby securing said stinger member 150 in place and preventing inadvertent or undesired disengagement or withdrawal of said stinger member 150 from bore 61.

In a preferred embodiment, proximity switches 68 and 69 are provided to sense conditions associated with automated connection assembly 10, and provide signals to an operator at a remote location when said conditions are satisfied. Proximity switch 69 senses whether cap member 180 is fully received within bore 61. Similarly, proximity switch 68 senses whether collet fingers 66 are fully recessed against cap member 180, thereby locking male stinger member 150 in place within said bore 61. Said proximity switches send visible and/or audible signals via wired circuitry or wireless transmission to a remote location which can be observed by an operator.

As male stinger member 150 is initially received within bore 61, upset section 174 of valve sleeve 170 (which has a larger outer diameter than the inner diameter of tapered valve sleeve actuation shoulder 64), contacts and engages against valve sleeve actuation shoulder 64. Continued winding of cable 21 on winch drum 26 of winch assembly 20 results in male stinger member 150 being received deeper into bore 61, thereby causing bias spring 173 to be compressed between upset section 174 of valve sleeve 170 and base plate 167. Compression of said bias spring 173 causes valve sleeve 170 to shift axially along the outer surface of body member 151 of male stinger member 150, thereby exposing transverse ports 153, which are positioned within internal flow chamber 67 in connection hub 70. In this manner, valve sleeve 170 can shift between a first normally closed position wherein transverse ports 153 are blocked or closed (such as when stinger member 150 is not received a predetermined distance within bore 61), and a second open position wherein said transverse ports 153 are open (such as when stinger member 150 is received a predetermined distance within bore 61). Because flow chamber 67 is in fluid communication with flow conduit 80, having curved section 83, while rubber or elastomeric sealing o-rings 172 form a fluid pressure seal between the outer surface of male stinger member 150 and the inner surface of bore 61 both above and below said flow chamber 67.

After said stinger member 150 is received within bore 61 and locked in place, pressurized fluid (including, without limitation, cement slurry) can be pumped from surface pumps through said fluid conduit 110. Referring to FIG. 14, such pressurized fluid can exit conduit 110 through distal end 111 of said conduit 110. Such pressurized fluid exiting distal end 111 of conduit 110 can then enter the inner bore of male stinger member 150 (shown in FIG. 8). Referring to FIG. 10, said pressurized fluid can then exit said stinger member 150 through exposed transverse ports 153 and enter internal flow chamber 67 in fluid connection hub 70.

Referring to FIG. 3, such pressurized fluid can generally pass through fluid connection hub 70, into fluid flow conduit 80, through open plug valve 90, through elbow flow connector 87 and inlet port receptacle 41, and into outer swivel housing 42. Such fluid can then flow through swivel assembly 40 in a manner well known to those having skill in the art, into central flow bore 46 (not visible in FIG. 3) of central swivel mandrel 45 and, ultimately, to equipment or components situated below said automated connection assembly 10 (such as, for example, cement head components and/or a string of casing or other tubular goods extending into a subterranean wellbore).

When release of said fluid conduit 110 from automated connection assembly 10 is desired (such as, for example, following cement pumping operations), the connection process outlined above can be generally repeated in reverse order. Referring to FIG. 10, fluid powered cylinders 65 can be remotely actuated from a location away from said automated connection assembly, thereby unlocking collet fingers 66 and allowing said collet fingers 66 to expand or move radially outward. This permits collet fingers 66 to move away from area of reduced diameter 185 of cap member 180 of male stinger member 150, and out of engagement against tapered shoulder surface 186 of cap member 180. Without said collet fingers acting on said tapered shoulder surface 186, said stinger member 150 is no longer locked against downward movement can be selectively disengaged or withdrawn from bore 61.

Referring to FIGS. 11 and 12, as cable 21 is unwound from winch drum 26, said cable 21 passes over pulley 29, allowing male stinger member 150 to withdraw from bore 61. As this occurs, upset section 174 of valve sleeve 170 moves away from, and disengages, valve sleeve actuation shoulder 64. As such, continued unwinding of cable 21 from winch drum 26 of winch assembly 20 results in axial compressive forces being removed from bias spring 173, thereby permitting said bias spring 173 to extend or expand. Extension of said bias spring 173 causes valve sleeve 170 to shift axially along the outer surface of body member 151 of male stinger member 150, thereby covering transverse ports 153 and blocking flow of fluid through said transverse ports and stinger member 150 when said stinger member 150 is withdrawn and disengaged from said bore 61.

A desired length of cable 21 can be unspooled from winch drum 26, which permits stinger member 150 (connected to distal end 111 of fluid conduit 110) to be lowered from an elevated position to a rig floor or other convenient staging area below. Such lowering process is aided by gravity. With said fluid conduit 110 lowered to desired location (such as a rig floor or other convenient staging area), said fluid conduit 110 can be safely and conveniently disconnected from stinger member 150 as part of the rig-down process. The relatively compact design of automated connection assembly 10 allows the entire assembly to be "racked back" in a drilling rig derrick when not in use, thereby reducing time and expense associated with rigging up and rigging down said assembly.

In a preferred embodiment, the automated connection assembly of the present invention can further comprise at least one safety pressure switch that senses the existence of an elevated fluid pressure across said connection, as well as controller safeguards that prevent disconnection in the event of such elevated pressure. Such safety means provide added protection against inadvertent or unwanted disconnection or separation of said connection members while under pressure.

Figure 15:
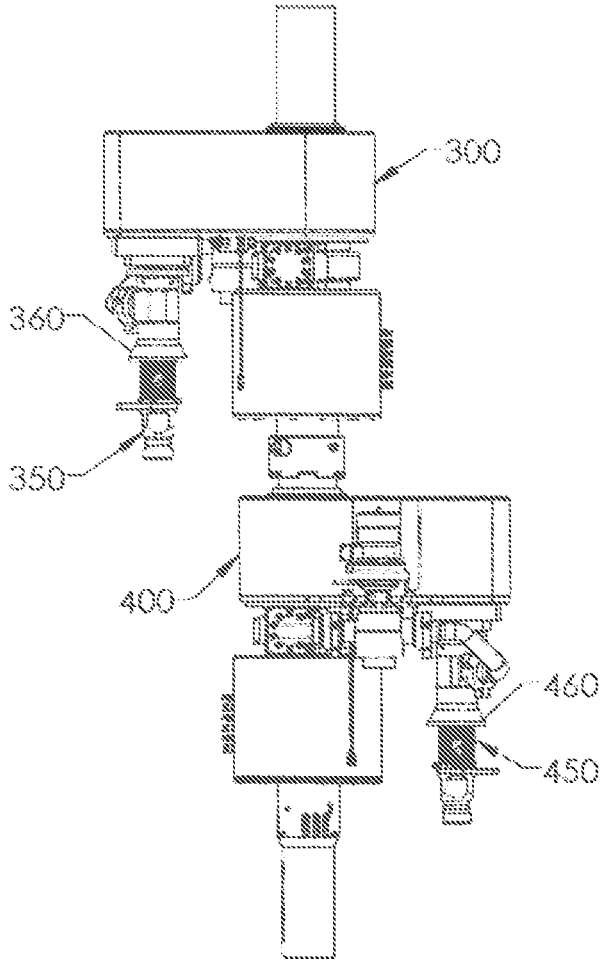
FIG. 15 depicts a side view of automated connection assemblies of the present invention installed on multiple hydraulic fracturing heads.

FIG. 15 depicts a side view automated connection assemblies 300 and 400 of the present invention utilized in connection with multiple hydraulic fracturing heads. In cementing applications, there is typically only one side entry port associated with an elevated cement head or similar apparatus, so only one automated connection assembly is typically required. However, with hydraulic fracturing heads, a plurality of side entry inlet ports are frequently employed; as a result, multiple automated connection assemblies (such as assemblies 300 and 400) can be arranged in "stacked" configuration in order to connect multiple conduits to said inlet ports.

Although not depicted in FIG. 15, it is to be observed that said hydraulic fracturing conduits can be attached to male stinger members 350 and 450, which can be received within entry guides 360 and 460, respectively. Said multiple automated connection assemblies 300 and 400 can be used lift each such conduit individually in sequence or, alternatively, all conduits can be lifted and connected simultaneously (although the combined weight of all such pumping conduits would be substantial). Said automated connection assemblies 300 and 400 can be powered through pneumatic or hydraulic hoses, but the preferred embodiment comprises a self-contained power pack.

The automated connection assembly of the present invention eliminates the need for hoisting or otherwise lifting personnel to an elevated location within a drilling rig derrick in order to connect a fluid flow conduit (such as a high pressure hose or chiksan line) to the inlet of an elevated cement head, or to the inlets of hydraulic fracturing head(s). In a preferred embodiment, such functions are controlled remotely by personnel situated on a drilling rig floor or other convenient staging area. Although the automated connection assembly of the present invention is described herein primarily in connection with cement head technology and cementing operations, it is to be observed that the present invention can be used to connect a fluid conduit to any number of other tools or equipment situated at an elevated location including, without limitation, hydraulic fracturing heads. Notwithstanding anything to the contrary contained herein, any and all dimensions or material selections described herein are illustrative only and are not intended to be, and should not be construed as, limiting in any manner.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for connecting a distal end of a fluid conduit to a fluid inlet, wherein said apparatus and said fluid inlet are positioned at an elevated location in a drilling rig derrick, comprising:

a) a stinger member operationally attached to said distal end of said fluid conduit and having at least one outlet port, wherein said stinger member further comprises an elongate body having a first end, a second end, an outer surface and a central flow bore oriented substantially parallel to the longitudinal axis of said body, and wherein said at least one outlet port comprises at least one transverse bore extending from said central flow bore to said outer surface;

b) a winch assembly disposed at said elevated location;

c) an elongated member having a first end, a second end and a length, wherein said first end is operationally attached to said winch assembly and said second end is operationally attached to said stinger member;

d) an inlet receptacle having a bore adapted to receive at least a portion of said stinger member while said stinger is lifted by said winch assembly, wherein said bore is in fluid communication with said fluid inlet; and e) a valve member comprising:

i) a sleeve slideably disposed over said stinger body; and ii) a spring, biasing said sleeve over said at least one outlet port;

wherein said valve member is adapted to shift between a first position wherein said least one outlet port of said stinger member is closed, and a second position wherein said at least one outlet port of said stinger member is open, and wherein said valve member remains in said first position unless said stinger member is at least partially received in said bore of said receptacle.

2. The apparatus of claim 1, further comprising a locking assembly for selectively locking said stinger member within said bore of said inlet receptacle.

3. The apparatus of claim 2, wherein said locking assembly is remotely controlled away from said apparatus.

4. The apparatus of claim 1, wherein rotation of said winch assembly is remotely controlled away from said apparatus.

5. The apparatus of claim 1, wherein said fluid conduit comprises at least one chiksan or hose.

6. The apparatus of claim 1, wherein said inlet receptacle further comprises a downwardly facing and tapered entry guide adapted to direct said stinger into said bore.

7. The apparatus of claim 1, wherein said first end of said stinger member comprises a rounded outer surface.

8. A method for connecting a distal end of a fluid conduit to a fluid inlet of a cementing or fracturing tool, wherein said fluid inlet of said cementing or fracturing tool is positioned at an elevated location in a drilling rig derrick, comprising:

a) attaching a stinger member to said distal end of said fluid conduit, wherein said stinger member comprises an elongate body having a first end, a second end, an outer surface, a central flow bore oriented substantially parallel to the longitudinal axis of said body, and at least one outlet port, and wherein said at least one outlet port comprises at least one transverse bore extending from said central flow bore to said outer surface;

b) providing an inlet receptacle in fluid communication with said fluid inlet of said cementing or fracturing tool;

c) lifting said stinger member and distal end of said fluid conduit until said stinger member is at least partially received in said inlet receptacle; and d) opening a valve assembly to open said at least one outlet port of said stinger member, wherein said valve assembly further comprises:

i) a sleeve slideably disposed over said stinger body; and ii) a spring, biasing said sleeve over said at least one outlet port when said valve assembly is in a closed position.

9. The method of claim 8, wherein said stinger member and distal end of said fluid conduit are lifted using a winch assembly comprising:

a) a rotatable winch drum operationally attached to said cementing or fracturing tool; and b) a cable having a first end, a second end and a length, wherein said first end is operationally attached to said winch drum, said second end is operationally attached to said stinger member and a portion of said cable is wrapped around said winch drum.

10. The method of claim 9, wherein rotation of said winch drum is remotely controlled away from said cementing or fracturing tool.

11. The method of claim 8, further comprising actuating a locking assembly to secure said stinger member in said inlet receptacle, wherein a fluid pressure seal is formed between said stinger member and said inlet receptacle.

12. The method of claim 11, wherein said locking assembly is controlled from a location away from said cementing or fracturing tool.

13. The method of claim 8, further comprising the steps of:

a) pumping cement, fracturing slurry or other fluid through said fluid conduit, stinger member, inlet receptacle and cementing or fracturing tool;

b) sensing fluid pressure across said inlet receptacle; and c) preventing disconnection of said stinger member from said inlet receptacle in the event that fluid pressure is sensed.

14. The method of claim 8, wherein said fluid conduit comprises at least one chiksan or hose.

15. The method of claim 8, wherein said inlet receptacle further comprises a downwardly facing and tapered entry guide having a bore and adapted to direct said stinger member into said bore.

16. The method of claim 8, wherein said first end of said stinger member comprises a substantially rounded outer surface.

* * * * *